US010053853B2

(12) United States Patent
Zarraonandia

(10) Patent No.: US 10,053,853 B2
(45) Date of Patent: Aug. 21, 2018

(54) CELL FOR STORMWATER MANAGEMENT SYSTEM

(71) Applicant: Pre-Con Products, Simi Valley, CA (US)

(72) Inventor: David Zarraonandia, Thousand Oaks, CA (US)

(73) Assignee: PRE-CON PRODUCTS, Simi Valley, CA (US)

( * ) Notice: Subject to any disclaimer, the term of this patent is extended or adjusted under 35 U.S.C. 154(b) by 58 days.

(21) Appl. No.: 15/043,032

(22) Filed: Feb. 12, 2016

(65) Prior Publication Data

US 2016/0333566 A1 Nov. 17, 2016

Related U.S. Application Data

(63) Continuation-in-part of application No. 14/710,230, filed on May 12, 2015, now Pat. No. 9,732,509.

(51) Int. Cl.

| | |
|---|---|
| ***E02B 11/00*** | (2006.01) |
| ***E03F 5/10*** | (2006.01) |
| ***E03F 1/00*** | (2006.01) |
| ***B28B 7/00*** | (2006.01) |
| ***B28B 7/18*** | (2006.01) |

(52) U.S. Cl.

CPC ..... *E03F 5/10* (2013.01); *B28B 7/0029* (2013.01); *B28B 7/0041* (2013.01); *B28B 7/18* (2013.01); *E03F 1/005* (2013.01); *E03F 5/101* (2013.01)

(58) Field of Classification Search

CPC ..... E03F 1/005

See application file for complete search history.

(56) References Cited

U.S. PATENT DOCUMENTS

| | | | | |
|---|---|---|---|---|
| 3,799,383 | A | 3/1974 | Gerhard | |
| 6,648,549 | B1 | 11/2003 | Urriola | |
| 6,991,402 | B2 | 1/2006 | Burkhart | |
| 7,160,058 | B2 | 1/2007 | Burkhart | |
| 7,344,335 | B2 | 3/2008 | Burkhart | |
| 7,387,467 | B2 * | 6/2008 | Kelty | E03F 1/002 220/567.1 |
| 7,704,011 | B2 | 4/2010 | Marshall | |
| D617,867 | S | 6/2010 | May | |
| 7,762,205 | B1 | 7/2010 | Veazey | |
| 7,798,747 | B1 | 9/2010 | de Bruijn et al. | |
| 8,360,100 | B2 | 1/2013 | Burkhart, Sr. et al. | |
| 8,590,564 | B2 | 11/2013 | Burkhart, Sr. et al. | |

(Continued)

FOREIGN PATENT DOCUMENTS

DE 4400183 A1 7/1995

*Primary Examiner* — John J Kreck

(74) *Attorney, Agent, or Firm* — Thompson Coburn LLP; Alan H. Norman

(57) ABSTRACT

A cell for a stormwater management system adapted for retaining or detaining stormwater. The cell comprises a body portion and an internal region. The body portion comprises a plurality of corner columns spaced from each other, a plurality of wall portions, and a window. Each wall portion extends from one of the corner columns to another of the corner columns. Each wall portion comprises an inner surface and an outer surface. The inner surface of each wall portion is curved. The window is through at least one of the wall portions. The window is adapted to permit passage of stormwater into and out of the internal region of the cell.

27 Claims, 17 Drawing Sheets

(56) References Cited

U.S. PATENT DOCUMENTS

| | | | | |
|---|---|---|---|---|
| 8,770,890 | B2 | 7/2014 | May et al. | |
| 8,985,897 | B2 | 3/2015 | Boulton et al. | |
| 2005/0100401 | A1 | 5/2005 | Urriola et al. | |
| 2007/0227094 | A1 | 10/2007 | Oscar | |
| 2008/0044231 | A1* | 2/2008 | Roelfsema | E02B 11/00 405/129.57 |
| 2009/0279953 | A1* | 11/2009 | Allard | E03F 1/005 405/39 |
| 2012/0201603 | A1 | 8/2012 | Boulton et al. | |
| 2014/0105684 | A1 | 4/2014 | Allard | |

* cited by examiner

CELL FOR STORMWATER MANAGEMENT SYSTEM

CROSS-REFERENCE TO RELATED APPLICATIONS

Continuation-in-part application of Ser. No. 14/710,230 filed on May 12, 2015.

STATEMENT REGARDING FEDERALLY SPONSORED RESEARCH OR DEVELOPMENT

Not Applicable.

APPENDIX

Not Applicable

BACKGROUND OF THE INVENTION

FIELD OF THE INVENTION

The present invention pertains to a cell for a stormwater management system adapted for retaining or detaining stormwater.

SUMMARY OF THE INVENTION

One aspect of the present invention is a stormwater management system adapted for retaining or detaining stormwater comprising a plurality of cells arranged in a generally honeycomb configuration. Each of the plurality of cells is generally hexagonal in cross-section and has an internal region. The plurality of cells is in fluid communication with one another to allow stormwater to flow from the internal region of one of the plurality of cells to the internal region of another of the plurality of cells.

Another aspect of the present invention is a cell for a stormwater management system adapted for retaining or detaining stormwater comprising a body portion and an internal region. The body portion is generally hexagonal in cross-section. The body portion comprises six sides and a window in one of the sides. The window is adapted to permit passage of stormwater into and out of the internal region.

Another aspect of the present invention is a method of forming a stormwater management system adapted for retaining or detaining stormwater comprising arranging a plurality of cells in a generally honeycomb configuration. Each of the plurality of cells is generally hexagonal in cross-section and has an internal region. The plurality of cells is arranged in a manner such that stormwater is able flow from the internal region of one of the plurality of cells to the internal region of another of the plurality of cells.

Another aspect of the present invention is a cell for a stormwater management system adapted for retaining or detaining stormwater. The cell comprises a body portion and an internal region. The body portion comprises a plurality of corner columns spaced from each other, a plurality of wall portions, and a window. Each wall portion extends from one of the corner columns to another of the corner columns. Each wall portion comprises an inner surface and an outer surface. The inner surface of each wall portion is curved. The window is through at least one of the wall portions. The window is adapted to permit passage of stormwater into and out of the internal region of the cell.

Another aspect of the present invention is a cell for a stormwater management system adapted for retaining or detaining stormwater. The cell comprises a body portion and an internal region. The body portion comprises a plurality of sides, an interior surface, and a window. The interior surface has a shape of a circular cylinder. The window is through at least one of the sides and the interior surface. The window is adapted to permit passage of stormwater into and out of the internal region of the cell.

Another aspect of the present invention is a method of manufacturing a stormwater management module for a stormwater management system. The method comprises positioning inner and outer mold components relative to each other such that the inner mold component is within the outer mold component. The outer mold component comprises at least three mold surfaces. The at least three mold surfaces collectively constitute an interior surface. The inner mold component comprises a round exterior surface. The interior surface of the at least three mold surfaces of the outer mold component and the round exterior surface of the inner mold component at least partially define an internal region. The method further comprises pouring liquid concrete between the interior surface of the outer mold component and the exterior surface of the inner mold component such that liquid concrete at least partially fills the internal region. The method further comprises allowing the liquid concrete to cure to form the stormwater management module. The method further comprises separating the stormwater management module from the inner and outer mold components.

Figure 1:
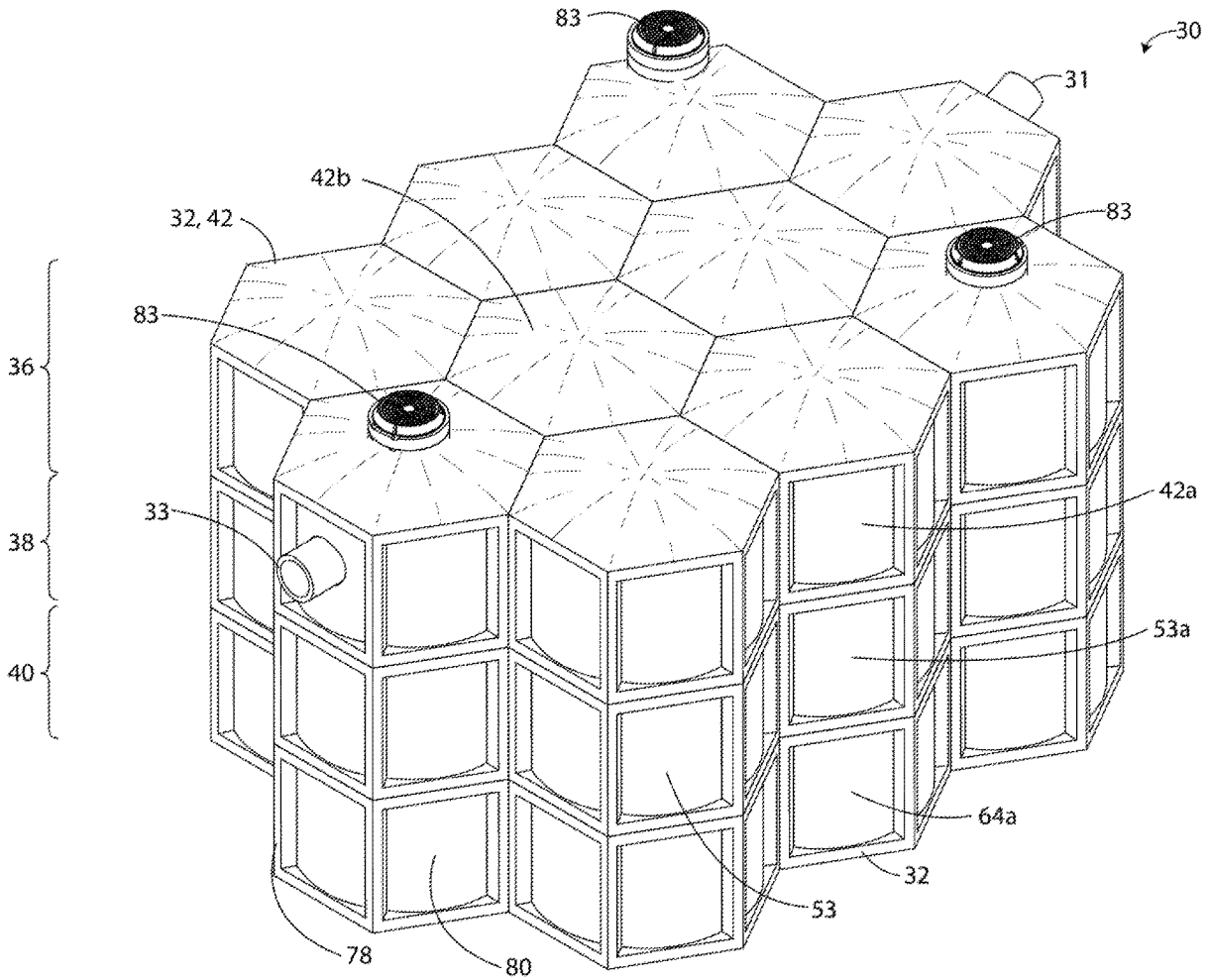
FIG. 1 is a perspective view of an embodiment of a stormwater management system of the present invention, the stormwater management system having a lower level of cells, an upper level of cells, and an intermediate level of cells.

Reference numerals in the written specification and in the drawing figures indicate corresponding items.

DETAILED DESCRIPTION OF THE PREFERRED

An embodiment of a stormwater management system is shown in FIGS. 1-4 and indicated generally by reference numeral 30. The stormwater management system 30 is adapted for retaining or detaining stormwater. The stormwater management system 30 comprises an inlet 31 and an outlet 33. The inlet 31 is adapted to enable stormwater to enter the stormwater management system 30 and the outlet 33 is adapted to enable stormwater to be removed from the stormwater management system. One of ordinary skill in the art will understand that the location of the inlet and the location of the outlet could be different from that shown in FIGS. 1 and 2. Moreover, one of ordinary skill in the art will understand that the stormwater management system could comprise additional inlets and/or outlets.

Figure 3:
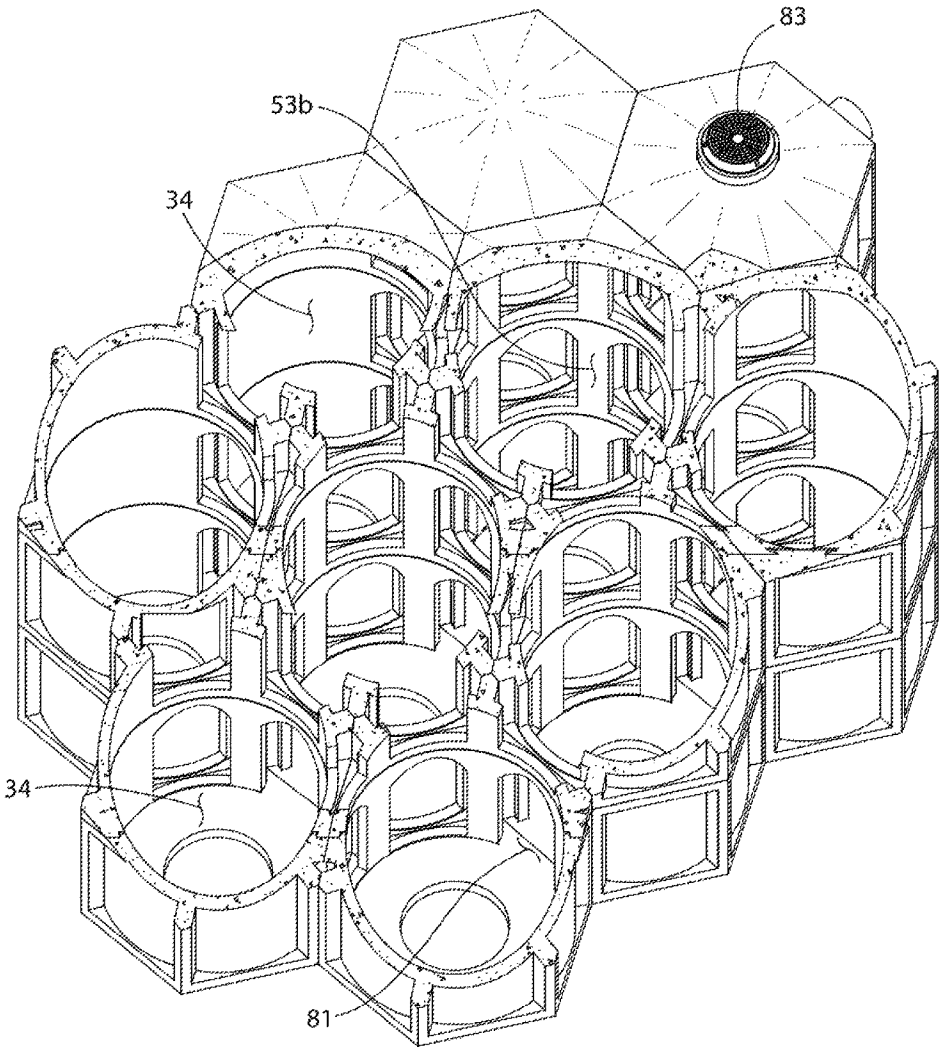
FIG. 3 is a perspective view of the stormwater management system of FIG. 1 with portions broken away to show detail.
Figure 4:
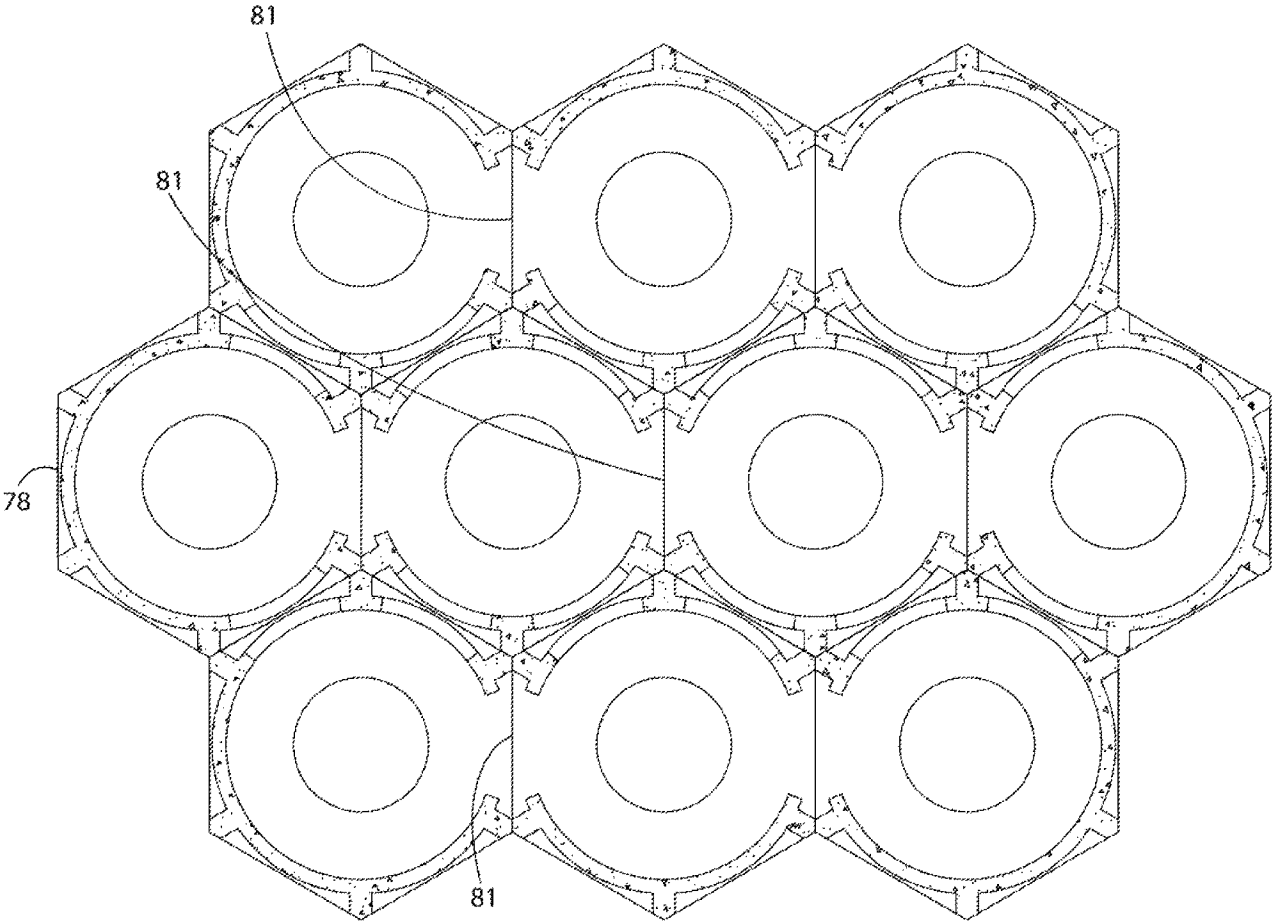
FIG. 4 is a cross-sectional view taken along the plane of line 4-4 of FIG. 2.

The stormwater management system 30 comprises a plurality of cells 32. Each cell 32 is made from a material suitable for use within a stormwater management system, including, but not limited to, concrete. The plurality of cells 32 are arranged in a generally honeycomb configuration. As can be seen in FIGS. 3 and 4, each of the plurality of cells 32 is generally hexagonal in cross-section and has an internal region 34. Moreover, each cell within the stormwater management system 30 is a module (i.e., of a unitary, one piece construction). It is to be understood, however, that the stormwater management system 30 could be constructed such that each cell (or alternatively, each of some of the cells) is made of separate pieces that collectively fit together to form a cell. The plurality of cells 32 are in fluid communication with one another to allow stormwater to flow from the internal region of one of the plurality of cells to the internal region of another of the plurality of cells.

Figure 2:
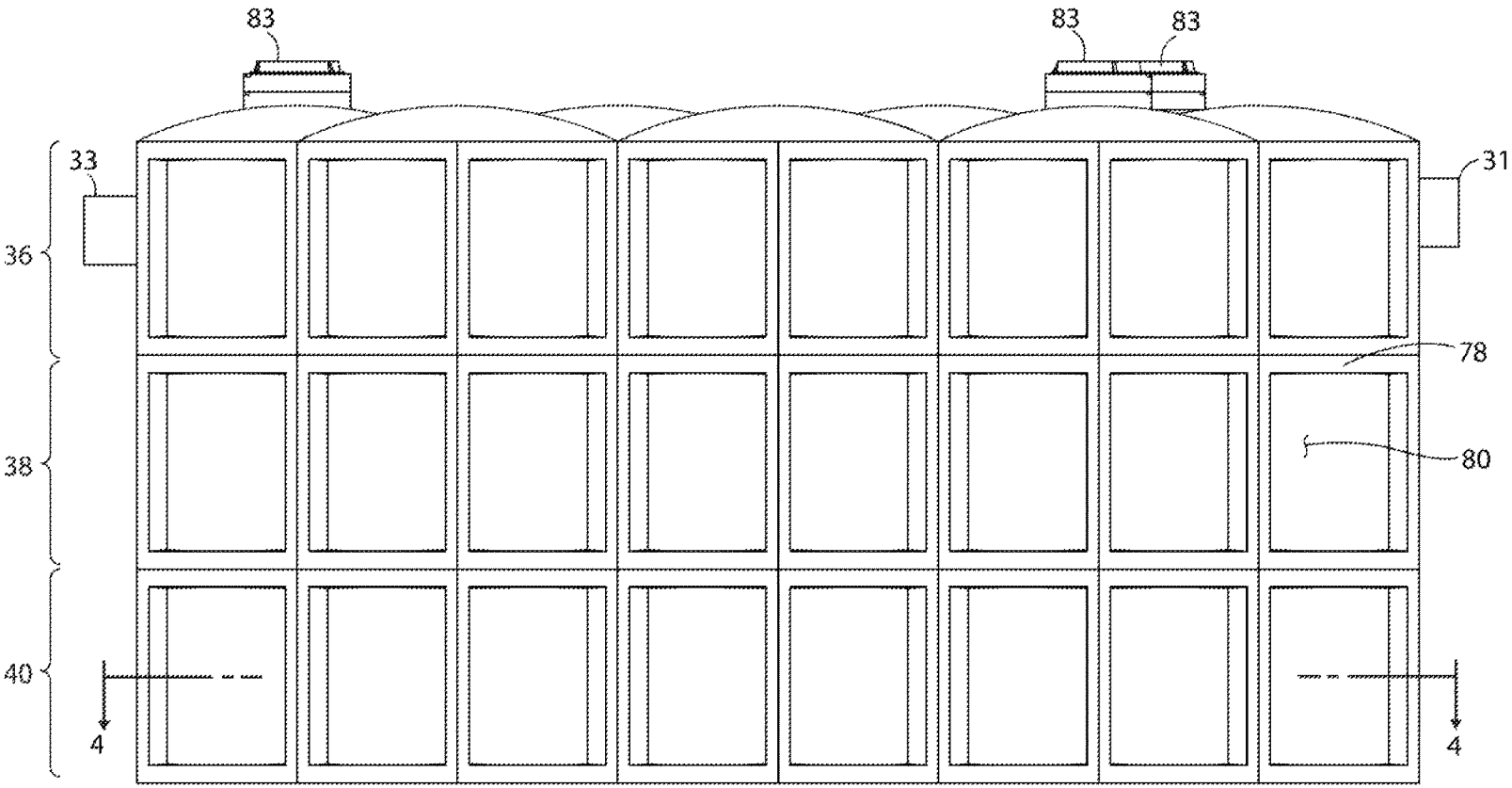
FIG. 2 is a side elevational view of the stormwater management system of FIG. 1.

As shown in FIGS. 1 and 2, the plurality of cells 32 comprises an upper level of cells 36, an intermediate level of cells 38, and a lower level of cells 40. The upper level of cells 36 is over the intermediate level of cells 38. Additionally, the upper level of cells 36 is in fluid communication with the intermediate level of cells 38. The intermediate level of cells 38 is over the lower level of cells 40. Additionally, the intermediate level of cells 38 is in fluid communication with the lower level of cells 40. Accordingly, the upper level of cells 36 is in fluid communication with the lower level of cells 40 via the intermediate level of cells 38.

Figure 5:
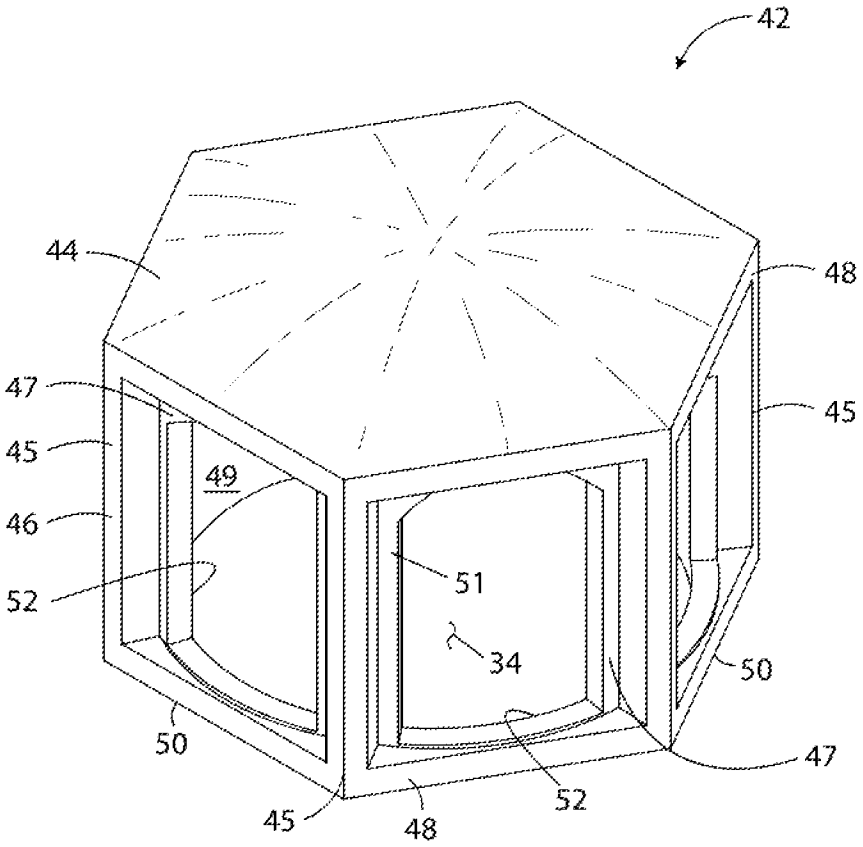
FIG. 5 is a perspective view of one of the cells of the upper level of cells of the stormwater management system of FIG. 1.

An exemplary cell 42 located within the upper level of cells 36 is shown in FIG. 5. Cell 42 comprises a top portion 44 and a body portion 46. The top portion 44 and the body portion 46 bound the internal region 34 of cell 42. The top portion 44 and the body portion 46 are generally hexagonal in cross-section. Although the cell 42 of the present embodiment is a module of a molded, one-piece construction, it is to be understood that the top portion 44 and the body portion 46 could be separate pieces that fit together to collectively form cell 42. The top portion 44 of cell 42 is domed such that an inner surface (not shown) of the top portion is concave. It is to be understood that the top portion 44 of cell 42 could alternatively be substantially flat. The body portion 46 includes six corner columns 45 spaced from each other, six sides 48, and a plurality of windows 52. Each side 48 comprises a wall portion 47. Each wall portion 47 extends from one of the corner columns 45 to another of the corner columns. Each wall portion 47 comprises an inner surface 49 and an outer surface 51. The inner surface 49 and the outer surface 51 of each wall portion 47 is curved. More specifically, the inner surface 49 and the outer surface 51 of each wall portion 47 is arcuate. The inner surfaces 49 of the plurality of wall portions 47 collectively constitute an interior surface. The interior surface is of a shape that is generally a right circular cylinder. The interior surface at least partially surrounds the internal region 34 of the cell 42. The body portion 46 further comprises a bottom edge 50. The body portion 46 is generally in the shape of a hexagonal cylinder. More specifically, the body portion 46 is generally in the shape of an equilateral hexagonal cylinder. Each window 52 is in a different one of the six sides 48 and through a wall portion 47. Additionally, each window is spaced from the top portion 44 and the bottom edge 50. Additionally, each window 52 is adapted to permit the passage of stormwater into and out of the internal region 34 of cell 42. Although FIG. 5 shows that each window 52 is of the same arched dimension, it is to be understood that the windows could be of different dimensions. Preferably, each window is dimensioned such that an area of each window is at least 50% of an area of the side of the cell in which each window is located. More preferably, each window is dimensioned such that an area of each window is at least 60% of an area of the side in which each window is located. It is also to be understood that a cell could have more or fewer windows than that of cell 42. For example, cell 42*a* has four windows and cell 42*b* has six windows (see FIG. 1).

Figure 6:
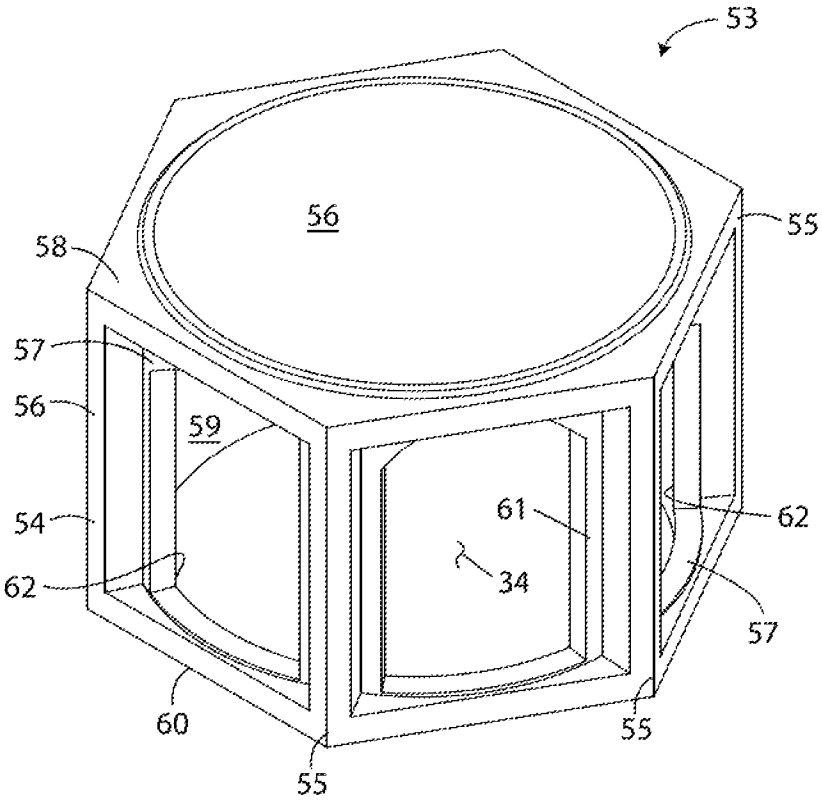
FIG. 6 is a perspective view of one of the cells of the intermediate level of cells of the stormwater management system of FIG. 1.

An exemplary cell 53 located within the intermediate level of cells 38 is shown in FIG. 6. Cell 53 comprises a body portion 54 having six corner columns 55, six sides 56, a top edge 58, a bottom edge 60, and a plurality of windows 62. The body portion 54 bounds the internal region 34 of cell 53. Each side 56 comprises a wall portion 57. Each wall portion 57 extends from one of the corner columns 55 to another of the corner columns. Each wall portion 57 comprises an inner surface 59 and an outer surface 61. The inner surface 59 and the outer surface 61 of each wall portion 57 is curved. More specifically, the inner surface 59 and the outer surface 61 of each wall portion 57 is arcuate. The inner surface 59 of the plurality of wall portions 57 collectively constitute an interior surface. The interior surface is of a shape that is generally a right circular cylinder. The interior surface at least partially surrounds the internal region 34 of the cell 53. The body portion 54 is generally in the shape of a hexagonal cylinder. More specifically, the body portion 54 is generally in the shape of an equilateral hexagonal cylinder. Each window 62 is in a different one of the six sides 56 and through a wall portion 57. Additionally, each window 62 is spaced from the top and bottom edges 58, 60 of the body portion 54. Additionally, each window 62 is adapted to permit the passage of stormwater into and out of the internal region 34 of cell 53. Although FIG. 6 shows that each window 62 is of the same arched dimension, it is to be understood that the windows could be of different dimensions. It is also to be understood that a cell could have more or fewer windows that that of cell 53. For example, cell 53*a* in FIG. 1 has four windows and cell 53*b* in FIG. 3 has six windows.

Figure 7:
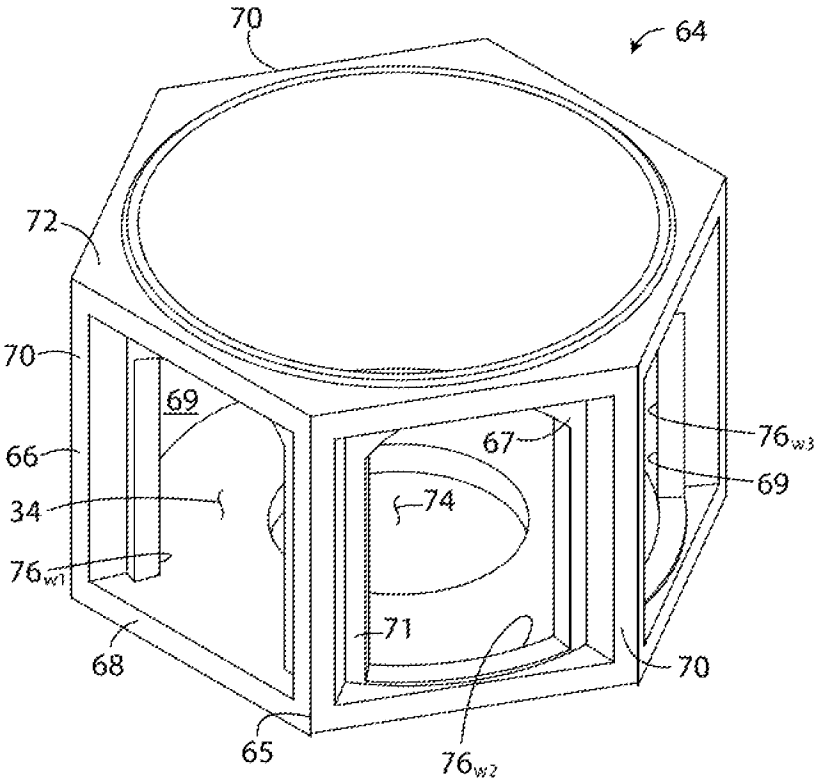
FIG. 7 is a perspective view of one of the cells of the lower level of cells of the stormwater management system of FIG. 1.

An embodiment of an individual cell 64 located within the lower level of cells 40 is shown in FIG. 7. Cell 64 comprises a body portion 66 and a bottom portion 68 that are generally hexagonal in cross-section. The body portion 66 and the bottom portion 68 bound the internal region 34 of cell 64. The body portion 66 includes six corner columns 65 spaced from each other, six sides 70, a top edge 72, and a plurality of windows 76. Each side 70 comprises a wall portion 67. Each wall portion 67 extends from one of the corner columns 65 to another of the corner columns. Each wall portion 67 comprises an inner surface 69 and an outer surface 71. The inner surface 69 and the outer surface 71 of each wall portion 67 is curved. More specifically, the inner surface 69 and the outer surface 71 of each wall portion 67 is arcuate. The inner surfaces 69 of the plurality of wall portions 67 collectively constitute an interior surface. The interior surface is of a shape that is generally a right circular cylinder. The interior surface at least partially surrounds the internal region 34 of cell 64. Although the cell 64 of the present embodiment is a module, it is to be understood that the bottom portion 68 and the body portion 66 could be separate pieces that fit together to collectively form cell 64. The body portion 66 is generally in the shape of a hexagonal cylinder. More specifically, the body portion 66 is generally in the shape of an equilateral hexagonal cylinder. The bottom portion 68 of cell 64 is substantially flat and constitutes a floor for the cell. The bottom portion 68 has an opening 74 that is adapted such that stormwater can pass therethrough and flow out of the internal region 34 of cell 64. Cell 64 has a first window $\mathbf{76}_{W1}$, a second window $\mathbf{76}_{W2}$, and a third window $\mathbf{76}_{W3}$. As shown in FIG. 7, each window 76 is in a different one of the six sides 70 and through a wall portion 67. The first window $\mathbf{76}_{W1}$ is spaced from the top edge 72. The second and third windows $\mathbf{76}_{W2}$, $\mathbf{76}_{W3}$ are spaced from the top edge 72 and the bottom portion 68. Each window 76 is adapted to permit passage of stormwater into and out of the internal region 34 of cell 64. Although FIG. 7 shows that each window 76 is of the same arched dimension, it is to be understood that the windows could be of different dimensions. It is to be understood that a cell could have more or fewer windows than that of cell 64. For example, cell 64*a* in FIG. 1 contains four windows.

As can be seen in FIG. 3, a body portion of each of the plurality of cells 32 within the stormwater management system 30 is substantially the same size as the body portion of the other cells within the stormwater management system. It is to be understood, however, that the body portion of at least some of the cells could be of a different size. Moreover, as can be seen in FIGS. 1-3, the plurality of cells 32 within the stormwater management system 30 are arranged in a manner such that the plurality of cells constitute a network having an outer periphery 78. Some of the sides of the plurality of cells 32 located along an outer edge of the stormwater management system 30 constitute the outer periphery 78. The cells 32 of the stormwater management system 30 are preferably arranged such that the outer periphery 78 does not contain any windows. Each side constituting the outer periphery 78 of the stormwater management system 30 preferably comprises a wall portion 80 that is curved. It is to be understood, however, that some or all of the sides that constitute the outer periphery 78 of the stormwater management system 30 could be substantially flat.

As shown in FIGS. 3 and 4, the lower level of cells 40 of the stormwater management system 30 are arranged in a manner so as to form a plurality of parallel walkways 81. Each walkway 81 extends in a single direction from a first side of the stormwater management system to an opposite side of the stormwater management system. Each walkway 81 enables a user to pass from the internal region 34 of one cell within the lower level of cells 40 to the internal region of another cell within the lower level of cells 40 without having to step over a raised surface. A user is able to gain access to the underground system 30 via a plurality of port holes 83 located within the upper level of cells 36.

The stormwater management system 30 is formed by arranging the lower level of cells 40, the intermediate level of cells 38, and the upper level of cells 36 in a generally honeycomb configuration. The intermediate level of cells 38 is arranged between the lower level of cells 40 and the upper level of cells 36. The upper level of cells 36 is arranged such that each one of the top portions 44 is in contact with the top portion 44 of another cell. Some of the upper level of cells 36 are arranged such that the top portions 44 of the cells are in contact with the top portions 44 of at least two other cells.

Figure 8:
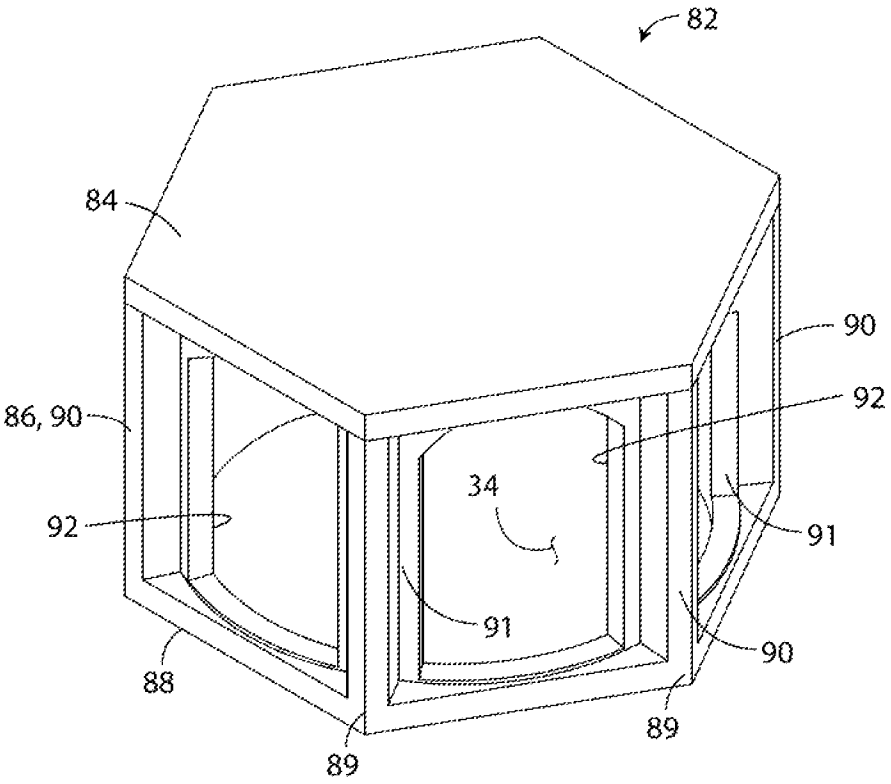
FIG. 8 is a perspective view of another embodiment of a cell of the present invention, the cell of FIG. 8 being similar to the cell of FIG. 5 but having a flat top portion.

Another embodiment of an individual cell 82 that could be located within the upper level of cells 36 is shown in FIG. 8. Cell 82 comprises a top portion 84, a body portion 86, and a bottom edge 88. The top portion 84 and the body portion 86 bound the internal region 34 of cell 82. Each of the top portion 84 and the body portion 86 is substantially hexagonal in cross-section. The top portion 84 of cell 82 is substantially flat. It is to be understood, however, that the top portion 84 of the cell 82 can be domed. Each of the body portion 86 and the top portion 84 are separate pieces that fit together to collectively form cell 82. The body portion 86 comprises six corner columns 89, six sides 90, and plurality of windows 92. Each side 90 comprises a wall portion 91. Each wall portion 91 extends from one of the corner columns 89 to another of the corner columns. Each window 92 is in a different one of the six sides 90 and through a wall portion 91. Each window is adapted to permit passage of stormwater into and out of the internal region 34 of cell 82. Although FIG. 8 shows that each window 92 is of the same arched dimension, it is to be understood that the windows could be of different dimensions. It is also to be understood a cell could have more or fewer windows than that of cell 82.

Figure 9:
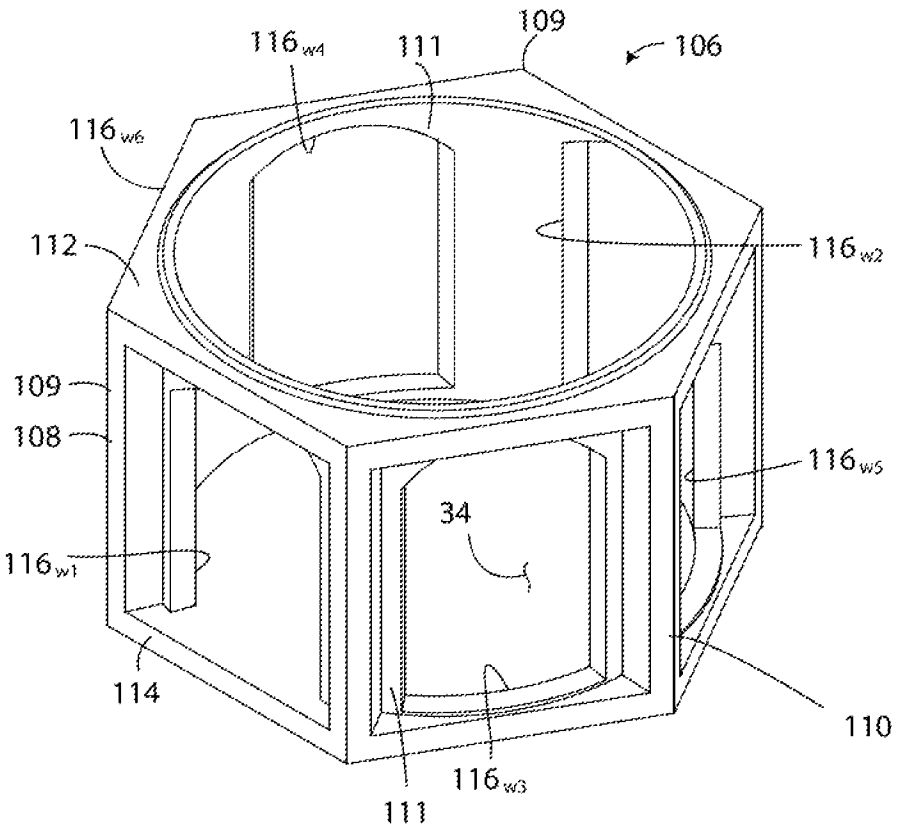
FIG. 9 is a perspective view of another embodiment of a cell of the present invention, the cell of FIG. 9 being similar to the cell of FIG. 7 but having a closed bottom portion.

An alternative embodiment of an individual cell 106 that could be located within the lower level of cells 40 is shown in FIG. 9. Cell 106 comprises a body portion 108 having six corner columns 109, six sides 110, a top edge 112, a bottom portion 114, and a plurality of windows 116. Each side 110 comprises a wall portion 111. Each wall portion 111 extends from one of the corner columns 109 to another of the corner columns. The body portion 108 comprises a first window $\mathbf{116}_{W1}$, a second window $\mathbf{116}_{W2}$, a third window $\mathbf{116}_{W3}$, a forth window $\mathbf{116}_{W4}$, a fifth window $\mathbf{116}_{W5}$, and a sixth window $\mathbf{116}_{W6}$. As shown in FIG. 9, each window is in a different one of the six sides 110 and through a wall portion 111. The first and second windows $\mathbf{116}_{W1}$, $\mathbf{116}_{W2}$ are opposite each other, the third and fourth windows $\mathbf{116}_{W3}$, $\mathbf{116}_{W4}$ are opposite each other, and the fifth and six windows $\mathbf{116}_{W5}$, $\mathbf{116}_{W6}$ are opposite each other. The first and second windows $\mathbf{116}_{W1}$, $\mathbf{116}_{W2}$ are spaced from the top edge 112 of the body portion 108. The first and second windows $\mathbf{116}_{W1}$, $\mathbf{116}_{W2}$ are not spaced from the bottom portion 114. The third, fourth, fifth, and sixth windows $\mathbf{104}_{W3}$, $\mathbf{104}_{W4}$, $\mathbf{104}_{W5}$, $\mathbf{104}_{W6}$ are spaced from the top edge 112 and bottom portion 114. The bottom portion 114 constitutes a floor for cell 106. Although FIG. 9 shows that each window is of the same arched dimension, it is to be understood the windows could be of different dimensions. It is also to be understood that a cell could have more or fewer windows than that of cell 106.

One of ordinary skill in the art will appreciate that the upper level of cells 36 within the stormwater management system 30 could be assembled of cells consistent with cell embodiment 42, cells consistent with cell embodiment 82, or cells consistent with cell embodiments 42 and 82. Similarly, one of ordinary skill in the art will appreciate that the lower level of cells 40 could be assembled of cells consistent with cell embodiment 64, cells consistent with cell embodiment 106, or cells consistent with cell embodiments of 64 and 106.

One of ordinary skill in the art will also appreciate that the stormwater management system 30 can be formed such that the intermediate level of cells 38 is omitted. Alternatively, one of ordinary skill in the art will appreciate that the stormwater management system 30 can be formed such that the stormwater management system includes more than one intermediate level of cells.

Figure 10:
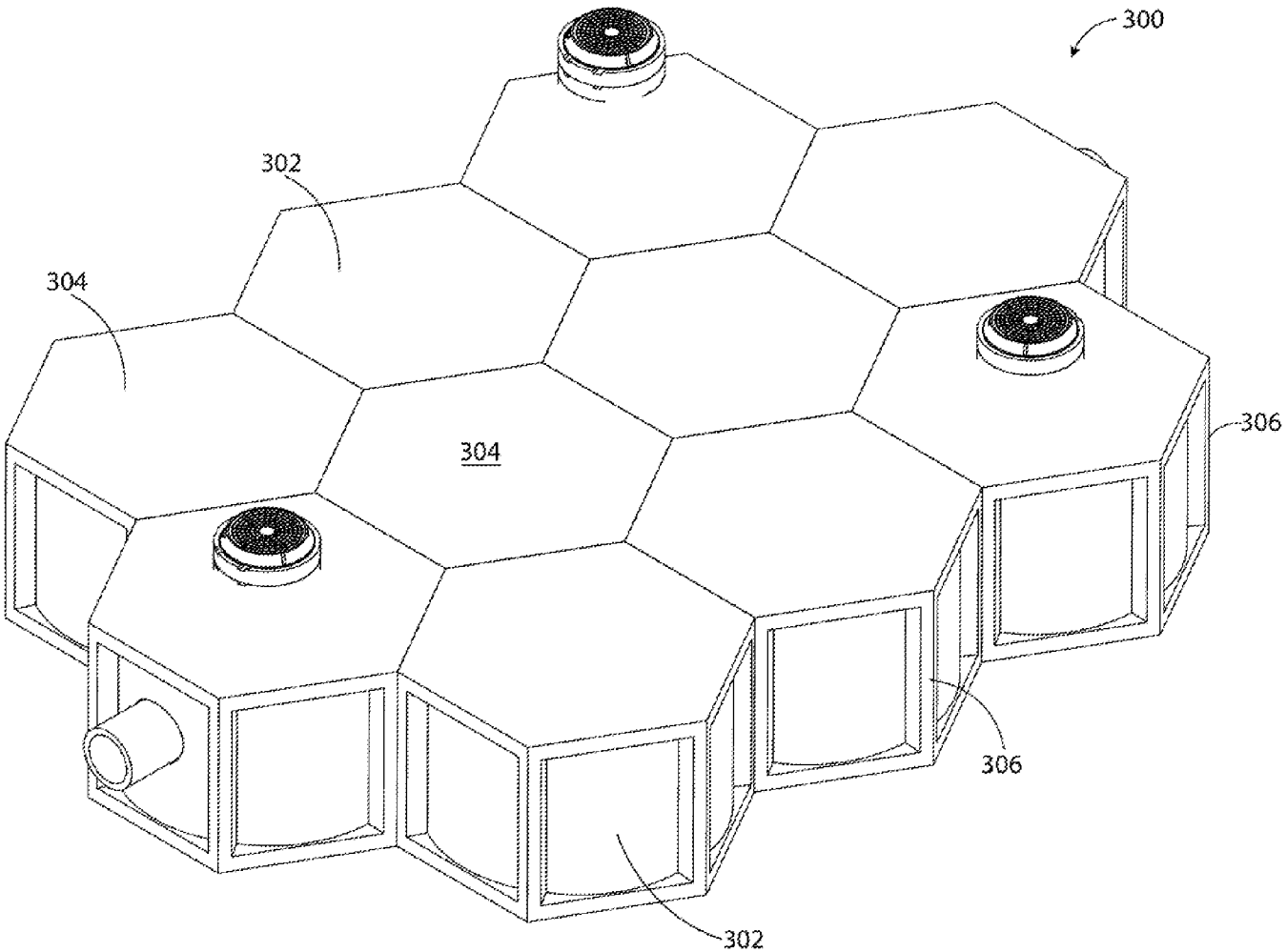
FIG. 10 is a perspective view of another embodiment of a stormwater management system of the present invention.
Figure 11:
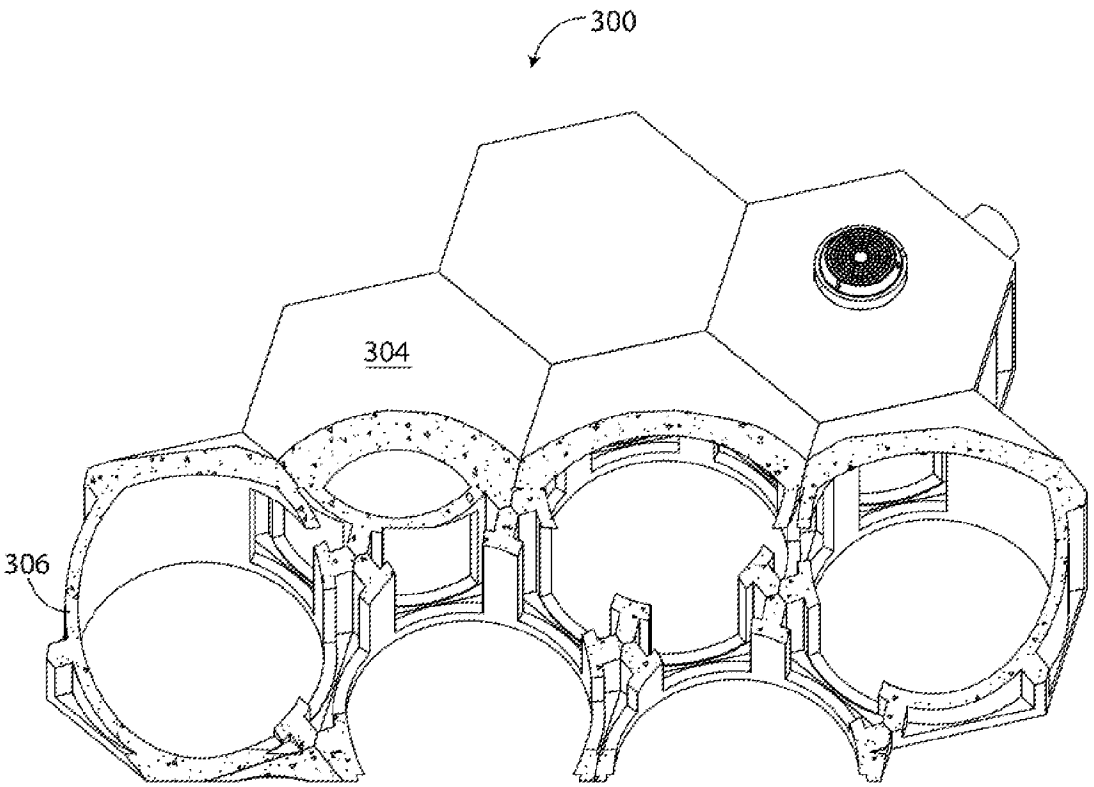
FIG. 11 is a perspective view of the stormwater management system of FIG. 10 with portions broken away to show detail.

Another embodiment of a stormwater management system is shown in FIGS. 10 and 11 and indicated generally by reference numeral 300. The underground system 300 is similar to the stormwater management system 30, except that it comprises only a single level of cells 302 wherein each cell is generally level with each other cell. Although FIGS. 10-11 depicts each of the plurality of cells 302 within the stormwater management system 300 as having a substantially flat top portion 304, one of ordinary skill in the art will understand that the top portion of each of the plurality of cells could be domed. Moreover, as shown in FIG. 11, each of the plurality of cells 302 comprises only a top portion 304 and a body portion 306. Notably, each of the plurality of cells does not comprise a bottom portion. One of ordinary skill in the art, however, will understand that all or some of the plurality of cells 302 could comprise a bottom portion. One of ordinary skill in the art will also understand that if all or some the plurality of cells 302 contain a bottom portion, the bottom portion may have an opening to enable stormwater to pass therethrough.

Figure 12:
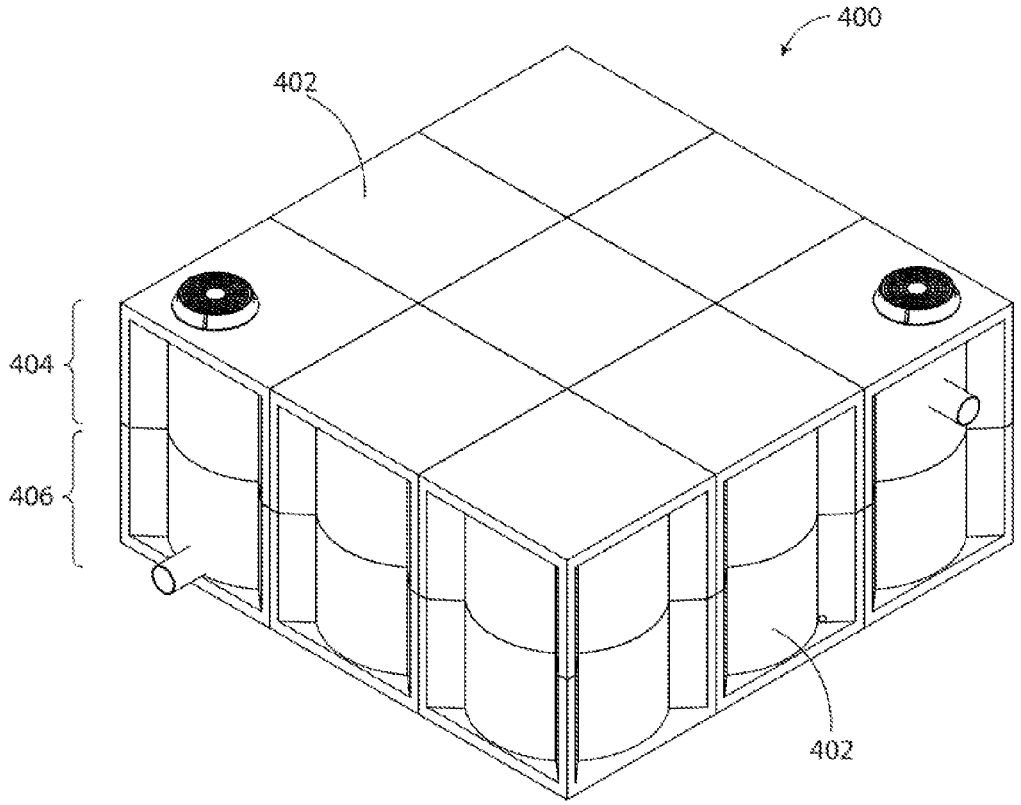
FIG. 12 is a perspective view of another embodiment of a stormwater management system of the present invention, the stormwater management system having an upper level of cells and a lower level of cells.
Figure 13:
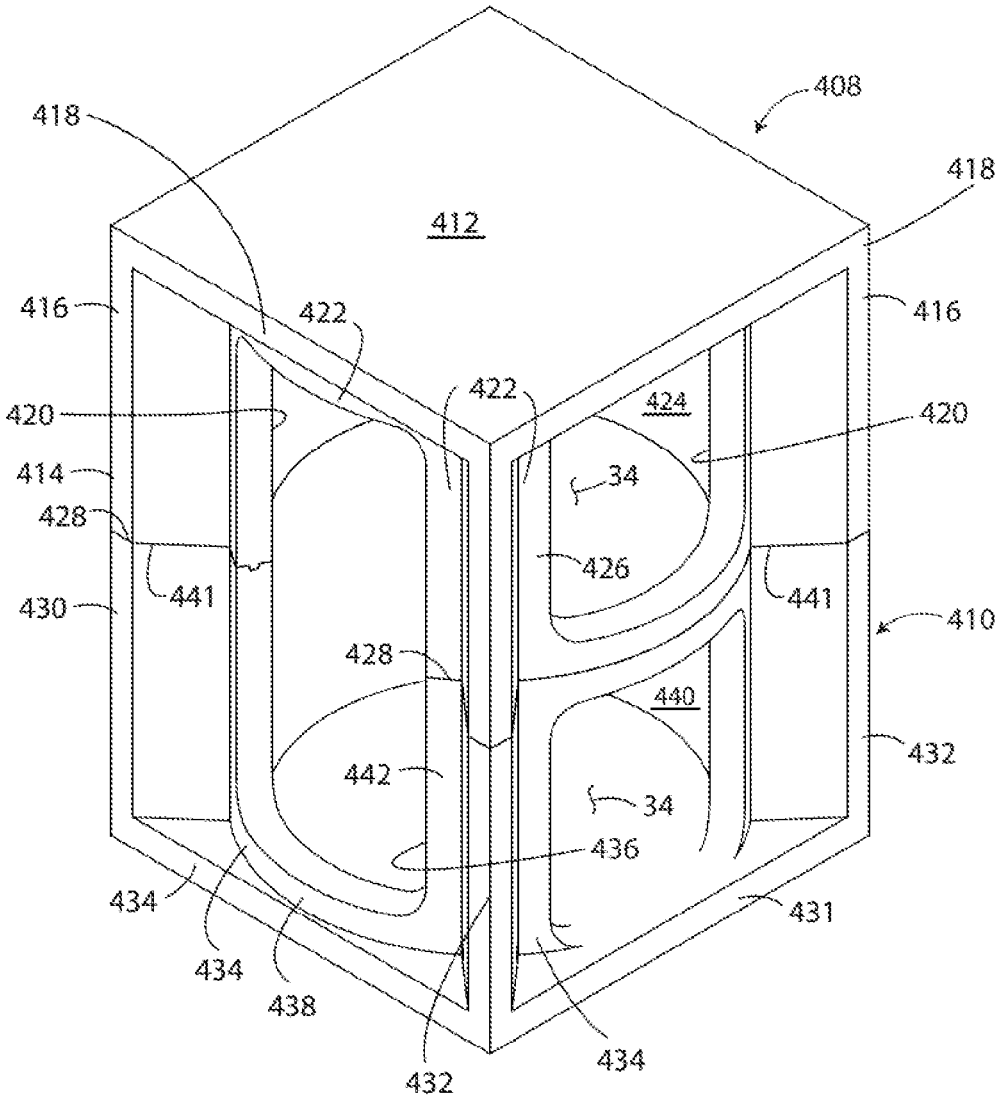
FIG. 13 is a perspective view of a cell of the upper level of cells and a cell of the lower level of cells of the stormwater management system of FIG. 12.

Another embodiment of a stormwater management system is shown in FIGS. 12 and 13 and indicated generally by reference numeral 400. The underground system 400 is similar to the stormwater management system 30. The underground system 400 comprises a plurality of cells 402. The plurality of cells 402 comprises an upper level of cells 404 and a lower level of cells 406. The upper level of cells 404 is in fluid communication with the lower level of cells 406.

An exemplary cell 408 located within the upper level of cells 404 is shown in FIG. 13. Cell 408 comprises a top portion 412 and body portion 414. The body portion 414 comprises four corner columns 416 spaced from each other, four sides 418, and a plurality of windows 420. Each side 418 comprises a wall portion 422. Each wall portion 422 comprises an inner surface 424 and an outer surface 426. The inner surface 424 and the outer surface 426 of each wall portion 422 is curved. More specifically, the inner surface 424 and the outer surface 426 of each wall portion 422 is arcuate. The inner surfaces 424 of the plurality of wall portions 422 collectively constitute an interior surface. The interior surface is of a shape that is generally a right circular cylinder. The interior surface at least partially surrounds the internal region 34 of cell 408. The body portion further comprises a bottom edge 428. Each window 420 is in a different one of the four sides 418 and through a wall portion 422. Each window 420 is spaced from the top portion 412. As seen in FIG. 13, each window may, but is not required to be, spaced from the bottom edge 428 as well.

An exemplary cell 410 located within the lower level of cells 406 is also shown in FIG. 13. Cell 410 comprises a body portion 430 and a bottom portion 431. The body portion 430 comprises four corner columns 432 spaced from each other, four sides 434, and a plurality of windows 436. Each side 434 comprises a wall portion 438. Each wall portion 438 comprises an inner surface 440 and an outer surface 442. The inner surface 440 and the outer surface 442 of each wall portion 438 is curved. More specifically, the inner surface 440 and the outer surface 442 of each wall portion 438 is arcuate. The inner surfaces 440 of the plurality of wall portions 438 collectively constitute an interior surface. The interior surface is of a shape that is generally a right circular cylinder. The interior surface at least partially surrounds the internal region 34 of cell 410. The body portion further comprises a top edge 441. Each window 436 is in a different one of the four sides 434 and through a wall portion 438. At least one window 436 is spaced from the bottom portion 431. As seen in FIG. 13, each window 436 may, but is not required to be, spaced from the top edge 441 as well.

Figure 14A:
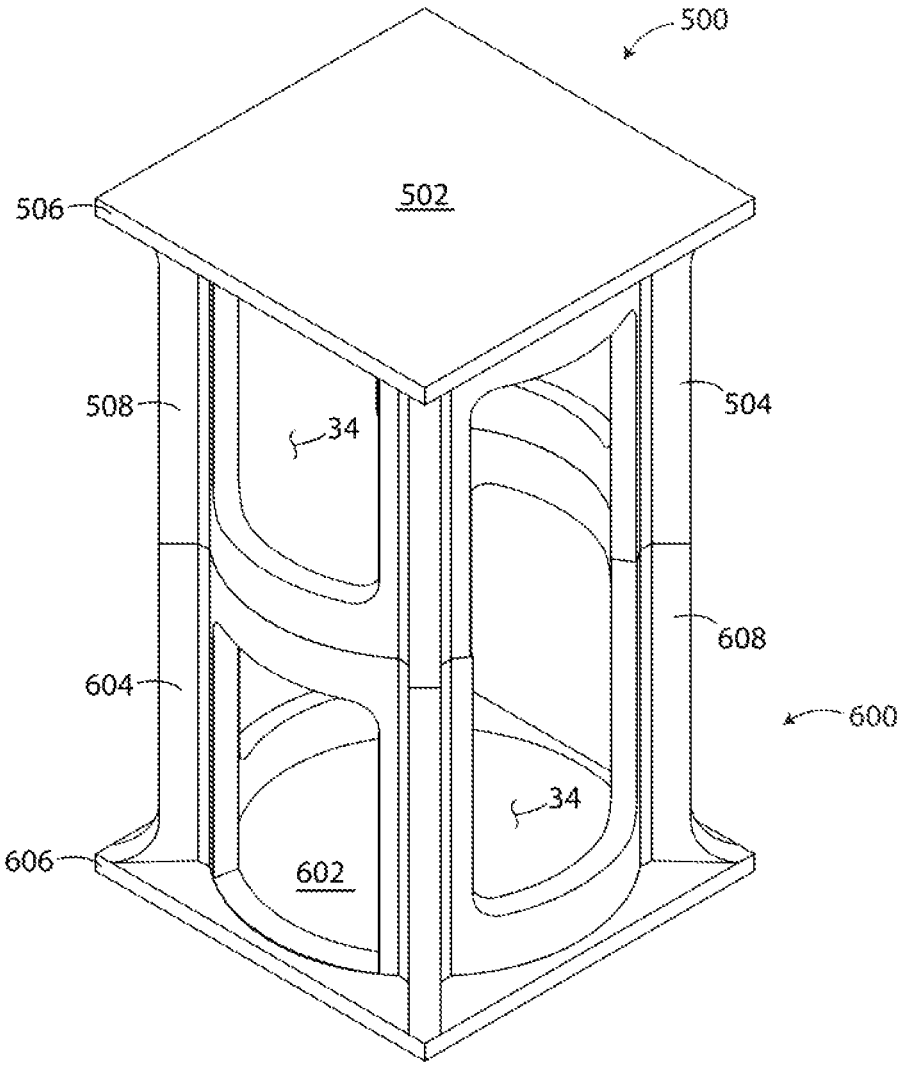
FIG. 14*a* is a perspective view of an alternative embodiment of a cell of the upper level of cells and an alternative embodiment of a cell of the lower level of cells of the stormwater management system of FIG. 12.
Figure 14B:
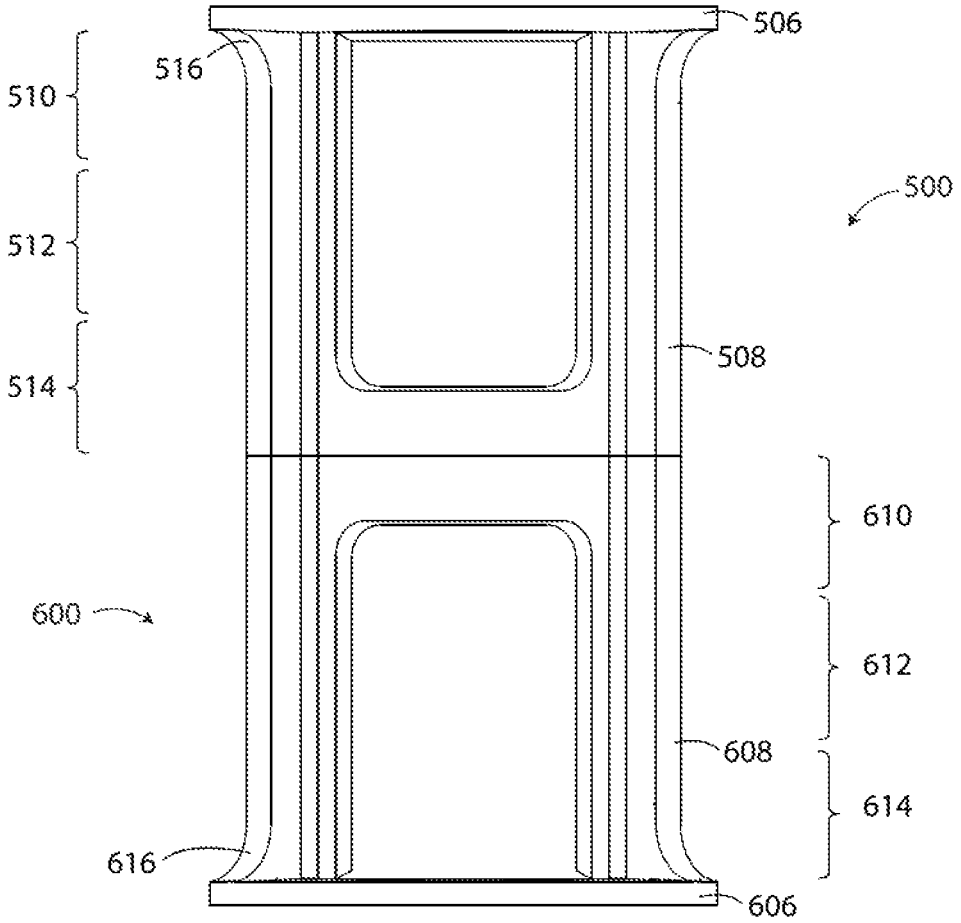
FIG. 14*b* is an elevational view of the upper cell and the lower cell shown in FIG. 14*a*.

Another embodiment of a cell 500 capable of being located within the upper level of cells 404 is shown in FIGS. 14*a* and 14*b*. Cell 500 is similar to cell 408. Cell 500 comprises a top portion 502 and a body portion 504. The top portion 502 has an outermost edge surface 506. The body portion 504 comprises four corner columns 508 spaced from each other. Each corner column 508 comprises a top region 510, an intermediate region 512, and an intermediate region 512. The intermediate region 512 extends from the top region 510 to the bottom region 514. Each corner column 508 of cell 500 is shaped such that the bottom region 514 and the intermediate region 512 of each corner column are spaced inwardly from the outermost edge surface 506 of the top portion 502. The top region 510 of each corner column 508 is curved or shaped such that a portion of the top region (e.g., tapered portion 516) extends to the outermost edge surface 506. Because the bottom region 514 and the intermediate region 512 of each corner column 508 are spaced inwardly from the outermost edge surface 506 of the top portion 502, stormwater is capable of flowing around each of the corner columns to an adjacent cell without passing through the internal region 34 of cell 500. It is to be understood that in an alternative embodiment of cell 500, the bottom region 514 and the intermediate region 512 of less than all of the corner columns 508 could be spaced inwardly from the outermost edge surface 506 such that stormwater is capable of flowing around some (but not all) of the corner columns 508 without passing through the internal region 34 of the cell. It is also to be understood that in an alternative embodiment of cell 500, the top region 510, the bottom region 514, and the intermediate region 512 of each (or some) of the corner columns 508 could be spaced inwardly from the outermost edge surface 506 of the top portion 502.

Another embodiment of a cell 600 capable of being located within the lower level of cells 406 is also shown in FIGS. 14*a* and 14*b*. Cell 600 is similar to cell 410. Cell 600 comprises a bottom portion 602 and a body portion 604. The bottom portion 602 has an outermost edge surface 606. The body portion 604 comprises four corner columns 608 spaced from each other. Each corner column 608 comprises a top region 610, a bottom region 614, and an intermediate region 612. The intermediate region 612 extends from the top region 610 to the bottom region 614. Each corner column 608 of cell 600 is shaped such that top region 610 and the intermediate region 612 of each corner column is spaced inwardly from the outermost edge surface 606 of the bottom portion 602. The bottom region 614 of each corner column 608 is curved or otherwise shaped such that a portion of the bottom region (e.g., tapered portion 616) extends to the outermost edge surface 606. Because the top region 610 and the intermediate region 612 of each corner column 608 are spaced inwardly from the outermost edge surface 606 of the bottom portion 602, stormwater is capable of flowing around each of the corner columns to an adjacent cell without passing through the internal region 34 of cell 600. Depending upon the arrangement of the cells and the types of cells used within a lower level of a stormwater management system, the capability of stormwater to flow around some or all of the corner columns of a cell without passing through an internal region of said cell could prevent a damming or pooling effect in the stormwater management system. It is to be understood that in an alternative embodiment of cell 600, the top region 610 and the intermediate region 612 of less than all of the corner columns 608 could be spaced inwardly from the outermost edge surface 606 such that stormwater is capable of flowing around some of the corner columns without passing through the internal region 34 of the cell. It is also to be understood that in an alternative embodiment of cell 600, the top region 610, the bottom region 614, and the intermediate region 612 of each (or some) of the corner columns 508 could be spaced inwardly from the outermost edge surface 606 of the bottom portion 602.

Figure 15:
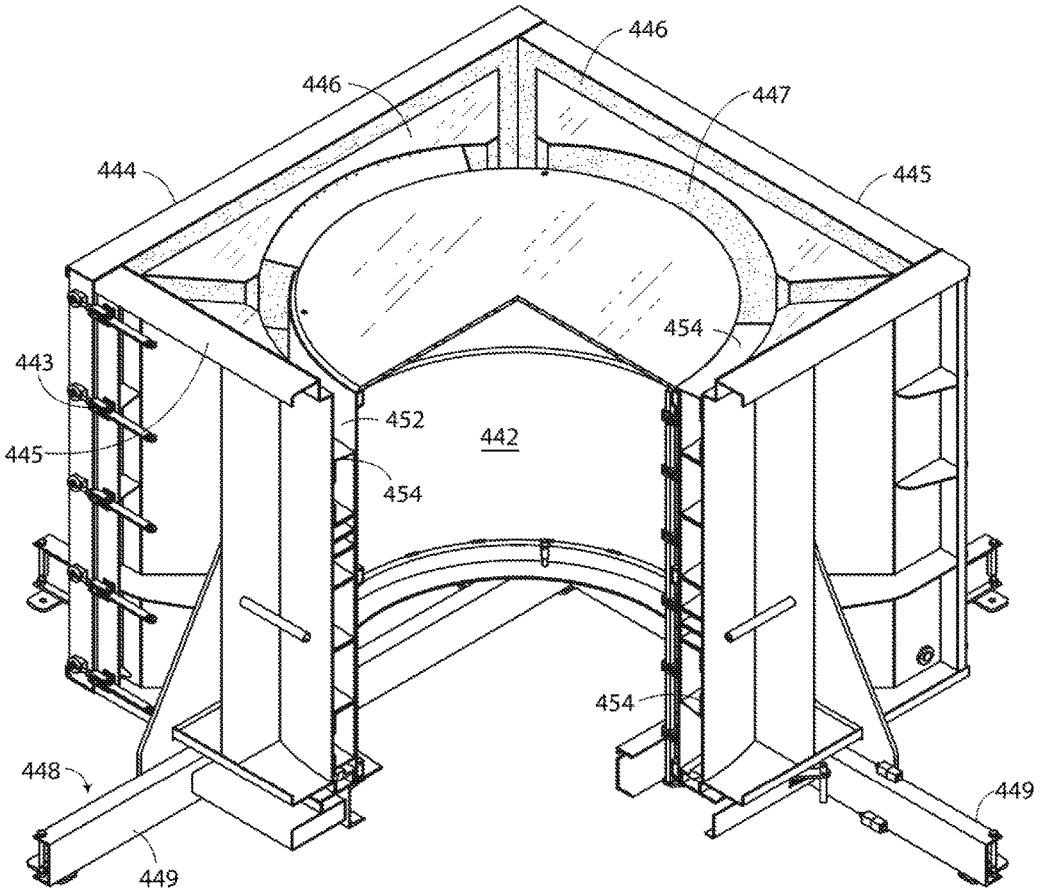
FIG. 15 is a perspective view of inner and outer mold components with portions broken away to show detail.
Figure 16:
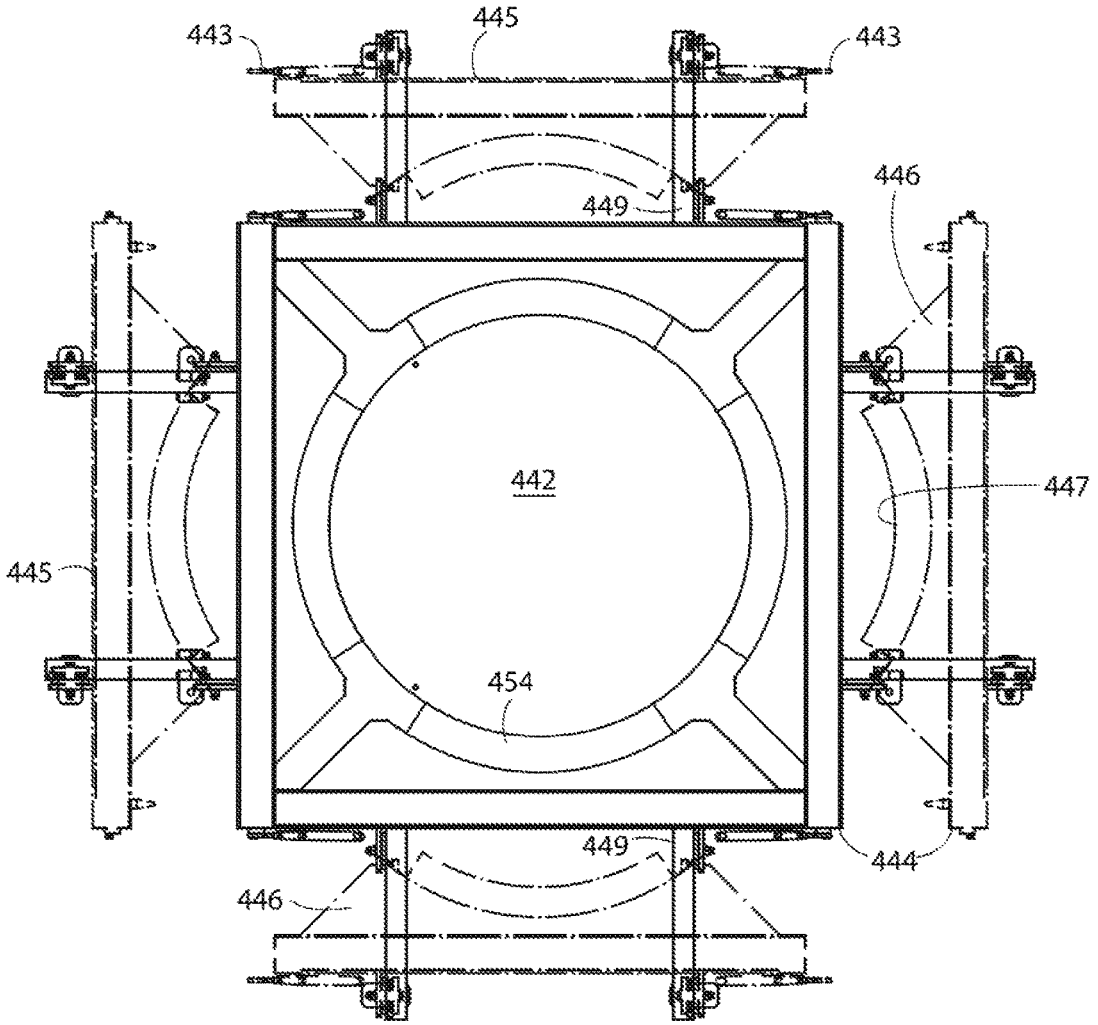
FIG. 16 is a top plan view of the inner and outer mold components of FIG. 15, walls of the outer mold component being shown in a latched configuration in solid lines and an unlatched configuration in dashed lines.

A method of manufacturing a stormwater management module comprises positioning an inner mold component 442 and an outer mold component 444 relative to each other such that the inner mold component is within the outer mold component. As seen in FIGS. 15 and 16, the outer mold component 444 comprises at three mold surfaces 446. Depending upon the module being manufactured and the module's intended shape, the outer mold component 444 can comprise either more or fewer mold surfaces. In FIGS. 15 and 16, the outer mold component 444 comprises a plurality of walls 445, each wall comprising a plurality of mold surfaces 446. The walls 445 are capable of being connected to each other via a plurality of latches 443. FIG. 16 shows the walls 445 in a latched configuration in sold lines. The plurality of mold surfaces 446 collectively constitute an interior surface. Preferably, each of the mold surfaces 446 comprises a rounded portion 447. The inner mold component 442 comprises a round exterior surface 452. The interior surface of the outer mold component 444 and the round exterior surface 452 collectively define an internal region capable of receiving liquid concrete. Preferably, the inner mold component 442 and/or the outer mold component 444 comprises a plurality of blockouts 454 (e.g. protruding pieces of sheet metal extending away from a surface) capable of being adjusted. More specifically, preferably the interior surface of the outer mold component 444 and/or the round exterior surface 452 of the inner mold component 442 comprises a plurality of blockouts 454 capable of being adjusted. When the inner mold component 442 is located within the outer mold component 444, the plurality of blockouts 454 define at least one blockout region that does not receive liquid concrete during the manufacturing process of a stormwater module, thereby forming windows in the stormwater module.

After the inner mold component 442 is located within the outer mold component 444, liquid concrete is poured between the interior surface of the outer mold component and the exterior surface 452 of the inner mold component so as to at least partially fill the internal region. The liquid concrete is allowed to cure to form the stormwater management module. After the liquid concrete cures, the stormwater management module is separated from the inner and outer mold components 442, 444. To separate the outer mold component 444 from the module, the walls 445 of the outer mold component are unlatched from each other. FIG. 15 shows the walls 445 in an unlatched configuration in dashed lines. Preferably, the outer mold component 444 further comprises a track system 448 comprising a plurality of rails 449. The track system 448 is adapted such that the walls 445 are capable of being slid away from each other along the rails 449. FIG. 15 shows the walls 445 of the outer mold component 444 slid away from each other via the track system 448 in dashed lines. To separate the inner mold component from 442 from the module, the inner mold component is collapsed along a seam (not shown), reducing the width of the inner mold component and enabling the inner mold component to be removed from the module.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, the order in which the steps of any method claim that follows are presented should not be construed in a manner limiting the order in which such steps must be performed.

What is claimed is:

1. A cell for a stormwater management system adapted for retaining or detaining stormwater, the cell comprising a body portion and an internal region, the body portion comprising a plurality of corner columns spaced from each other, a plurality of wall portions, and a window, each wall portion extending from one of the corner columns to another of the corner columns, each wall portion comprising an inner surface and an outer surface, the inner surface of each wall portion being curved and defining a cylindrical interior volume, the window being through at least one of the wall portions, the window being adapted to permit passage of stormwater into and out of the internal region of the cell.

2. A cell as set forth in claim 1 wherein the internal region is bounded by the wall portions.

3. A cell as set forth in claim 1 wherein the inner surfaces collectively constitute an interior surface, and the interior surface at least partially surrounds the internal region of the cell.

4. A cell as set forth in claim 1 wherein the inner surface of each of the wall portions is arcuate.

5. A cell as set forth in claim 4 wherein the inner surfaces collectively constitute an interior surface, and the interior surface generally has a shape of a right circular cylinder.

6. A cell as set forth in claim 1 wherein the cell comprises a top portion.

7. A cell as set forth in claim 6 wherein the window is spaced from the top portion of the cell.

8. A cell as set forth in claim 6 wherein the cell comprises a bottom portion, the body portion located between the top and bottom portions.

9. A cell as set forth in claim 8 wherein the window is spaced from the top and bottom portions of the cell.

10. A cell as set forth in claim 8 wherein the internal region is bounded by the top portion, the body portion, and the bottom portion.

11. A cell as set forth in claim 8 wherein the top portion, body portion, and bottom portion collectively constitute a module.

12. A cell as set forth in claim 1 wherein the window constitutes a first window, and the cell comprises a second window through at least a second one of the curved wall portions, the second window being spaced from the first window.

13. A cell as set forth in claim 1 wherein the cell comprises four corner columns and four wall portions.

14. A cell as set forth in claim 1 wherein the cell comprises six corner columns and six wall portions.

15. A cell as set forth in claim 1 wherein the cell comprises a top portion having an outermost edge surface, at least one of the corner columns of the cell being shaped in a manner such that a portion of said corner column is spaced inwardly from the outermost edge surface.

16. A cell as set forth in claim 1 wherein the cell comprises a bottom portion having an outermost edge surface, at least one corner column of the cell being shaped in a manner such that a portion of said corner column is spaced inwardly from the outermost edge surface.

17. A cell as set forth in claim 1 wherein the body portion comprises concrete.

18. A cell as set forth in claim 1 wherein the body portion is impermeable.

19. A cell for a stormwater management system adapted for retaining or detaining stormwater, the cell comprising a body portion and an internal region, the body portion comprising a plurality of corner columns spaced from each other, a plurality of wall portions, and a window, each wall portion extending from one of the corner columns to another of the corner columns, each wall portion comprising an inner surface and an outer surface, the inner surface of each wall portion being curved, the outer surface of each of the wall portions being curved, the window being through at least one of the wall portions, the window being adapted to permit passage of stormwater into and out of the internal region of the cell.

20. A cell as set forth in clam 19 wherein the outer surface of each the wall portions is arcuate.

21. A cell for a stormwater management system adapted for retaining or detaining stormwater, the cell comprising a body portion and an internal region, the body portion comprising a plurality of sides, an interior surface, and a window, the interior surface having a shape of a circular cylinder, the interior surface being impermeable, the window being through at least one of the sides and the interior surface, the window being adapted to permit passage of stormwater into and out of the internal region of the cell.

22. A cell as set forth in claim 21 wherein the body portion comprises four sides.

23. A cell as set forth in claim 22 wherein the body portion is generally square in cross-section.

24. A cell as set forth in claim 21 wherein the body portion comprises six sides and is generally hexagonal in cross-section.

25. A cell as set forth in claim 21 wherein the window constitutes a first window and the cell comprises a second window, the second window being through at least a second one of the sides, the second window being spaced from the first window.

26. A cell as set forth in claim 21 wherein the interior surface has a shape of a right circular cylinder.

27. A stormwater management system comprising a plurality of cells, each cell of the plurality of cells being as set forth in claim 21.

* * * * *